United States Patent [19]

Adams et al.

[11] Patent Number: 4,684,060

[45] Date of Patent: Aug. 4, 1987

[54] FURNACE FAN CONTROL

[75] Inventors: John T. Adams, Saint Louis, Mo.; Dale A. Mueller, Plymouth, Minn.

[73] Assignee: Honeywell Inc., Minneapolis, Minn.

[21] Appl. No.: 866,553

[22] Filed: May 23, 1986

[51] Int. Cl.[4] ..... F23N 5/20

[52] U.S. Cl. ..... 236/11; 62/231

[58] Field of Search ..... 236/10, 11, 46 R; 62/180, 231; 126/110 R; 165/12

[56] References Cited

U.S. PATENT DOCUMENTS 3,726,473 4/1973 Sapir .
4,136,730 1/1979 Kinsey ..... 165/12
4,292,813 10/1981 Paddock .
4,356,962 11/1982 Levine .
4,449,375 5/1984 Briccetti ..... 62/89
4,460,123 7/1984 Beverly .
4,467,617 8/1984 Morgan et al. ..... 62/180

OTHER PUBLICATIONS

Honeywell Inc. Brochure No. 68-0024-1, "Fan and Limit Controllers", Rev. 1-85.

*Primary Examiner*—William E. Wayner
*Attorney, Agent, or Firm*—Clyde C. Blinn

[57] ABSTRACT

A furnace fan control for providing operation of the fan after the termination of the furnace burner in an adaptive manner to provide for longer fan operations after the burner turns OFF, as the burner ON time increases.

4 Claims, 4 Drawing Figures

FURNACE FAN CONTROL

BACKGROUND AND SUMMARY OF THE INVENTION

For many years forced air heating systems wherein a furnace has a fuel burning apparatus heating air and the air is circulated to a space in which the temperature is being controlled by a circulation fan, have used temperature responsive fan controls such as the L4064B Fan and Limit Controller shown in Instruction Sheet 68-0024-1, Rev. 1-85, of Honeywell Inc. In such a system, when a burner operates and the temperature of the furnace or plenum reaches some predetermined temperature, the air circulation fan is energized and remains energized until the operation of the heating device is terminated and the temperature of the air in the plenum drops to some predetermined lower temperature. The temperature for starting up the fan and stopping the fan has some temperature differential which is generally preset in the fan control. With such fan controls, the placement of a temperature responsive element of the fan control in the furnace plenum is quite critical to prevent the fan from operating for a longer time period than necessary and circulating cold air to the space.

Other types of fan controls make use of timers which, when the heating device is energized and the plenum air temperature increases, the fan is turned on by a temperature responsive element and the termination of the fan operation takes place after some predetermined time. Still other types of fan controls are completely time controlled in that they turn on the fan a predetermined time after the heating apparatus is energized and turn off the fan a predetermined time after the heating apparatus is turned off. Such time controlled fan controls must be tailored to the particular furnace and are not universally adapted to provide the most satisfactory operation for a furnace.

The present invention is concerned with an adaptive time control for the turn off of a furnace circulator fan. The furnace is normally turned on through a conventional room thermostat and at the same time a circulation fan is energized. Depending upon the length of the time of operation of the heating apparatus or burner, upon the termination of the burner, the circulation fan is maintained energized. If the furnace is operated for longer periods of time and a considerable amount of heat is stored in the furnace, after deenergization of the furnace, the circulation fan will be maintained for a longer period of time.

Specifically, the invention concerns a timer control which is adapted for use to control the continued operation of the circulation fan after the burner is turned off having a first timer which has a high and a low timing count fill rate and a second timer which has a high fill rate. The first timer is reset upon receiving an input signal and provides an output signal for energizing the circulation fan. Simultaneously with the operation of the circulation fan, the second timer is energized. Upon termination of the burner operation by removal of the input signal to the first timer, the first timer is energized at a high counting fill rate but, depending upon the length of time the burner has been operating, the second timer can adjust the fill rate of the first timer to provide a period of circulation fan operation dependent upon the burner ON time.

DESCRIPTION OF THE PREFERRED EMBODIMENT

Figure 1:
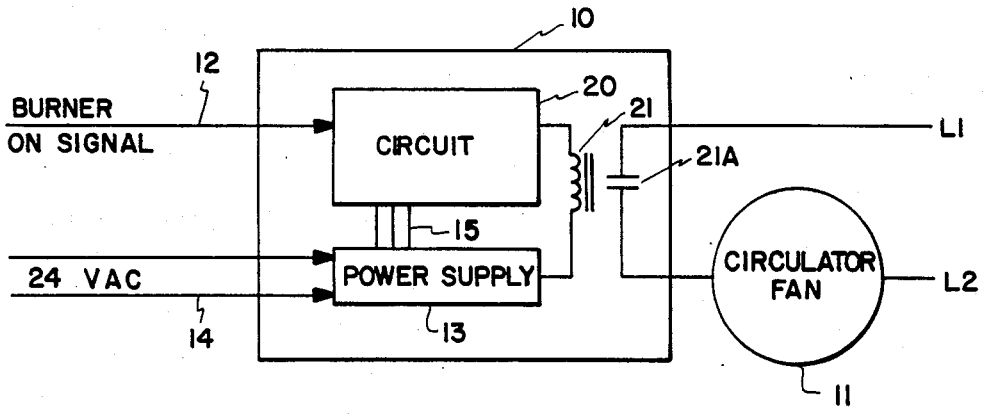
FIG. 1 is a schematic of the furnace fan control.

Referring to FIG. 1, the timer control or furnace fan control 10 is shown connected to a circulator fan 11 which might be an air circulation fan of a temperature conditioning apparatus or furnace having a fuel or gas burner supplying heated air to a space. Fan control 10 receives an input signal at 12 indicative of the operation of the temperature conditioning apparatus or burner when a need for heat is called for by a conventional room thermostat. A power supply 13 receives alternating current voltage from a source of power over circuits 14. Power supply 13 furnishes power over circuits 15 to a timing circuit 20 which controls the operation of a relay 21 connected in the power supply circuit of fan 11.

Figure 2:
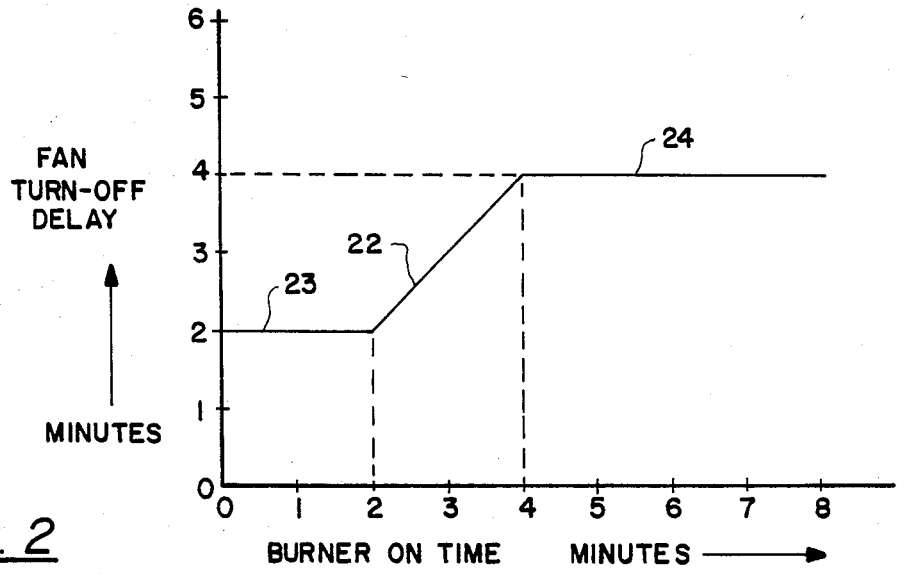
FIG. 2 is a graphical representation of the operation of the fan control.
Figure 4:
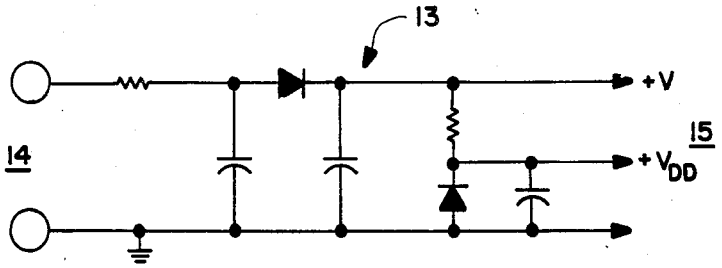
FIG. 4 is a power supply circuit for the furnace fan control.

By means of the timing circuit, the operation of the circulator fan, after the burner operation is terminated, is controlled in response to the burner ON time as graphically shown in FIG. 2. As the burner ON time increases in total minutes, the fan operation, after the turn off of the burner, is continued for a time period of minutes as shown by the graphical representation 22. Specifically, at burner operations of up to two minutes, the fan is operated for two minutes shown at 23 after the burner is turned off. When the burner operates for a period of time greater than four minutes, the fan is operated for four minutes, as shown at 24 after the burner is turned off. Between the two minute and four minute operation of the burner, the fan operation is linearly changed between the two minute and the four minute operation as shown at 22.

Figure 3:
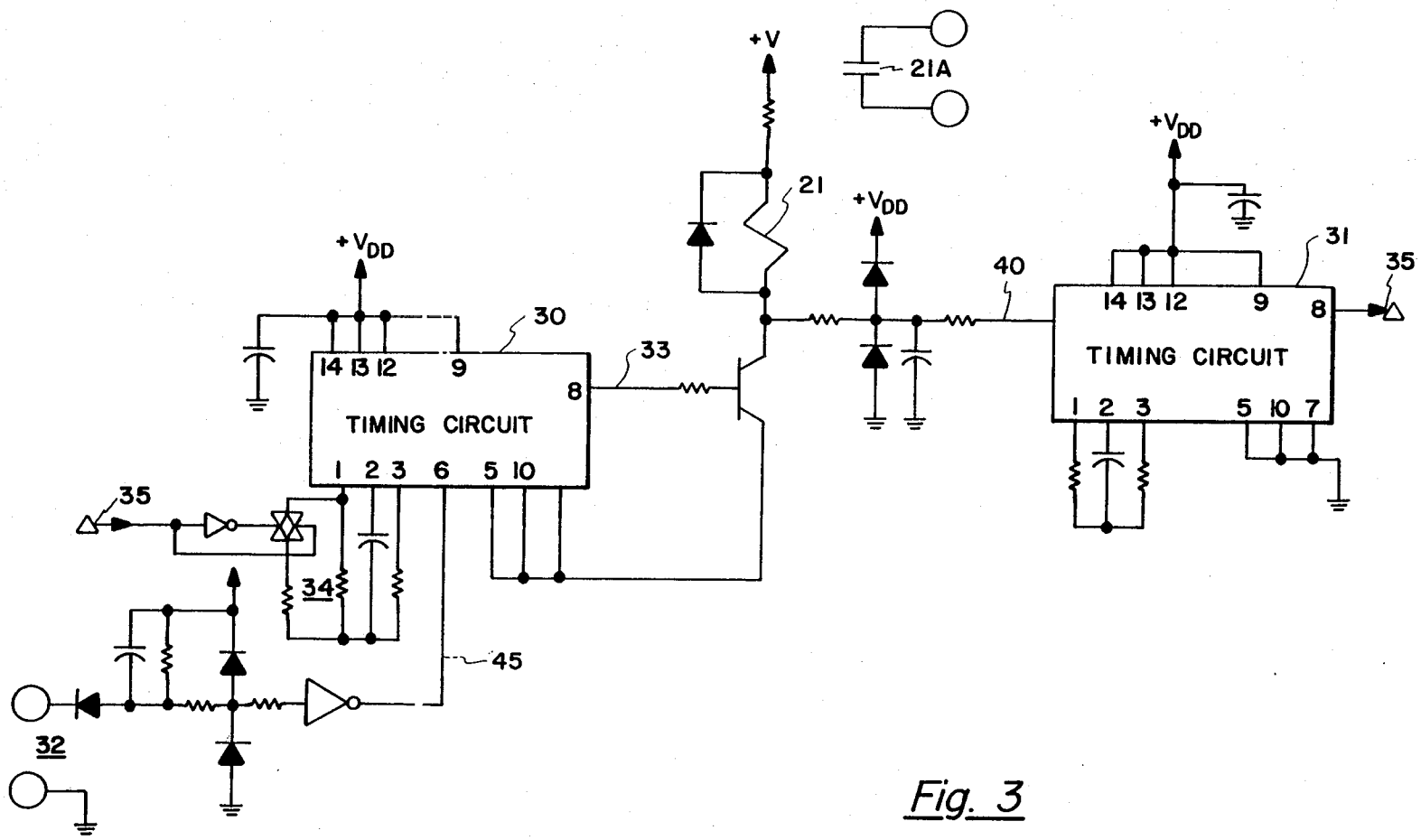
FIG. 3 is a circuit diagram of the fan control timers.

The specific circuit of the preferred embodiment is shown in FIG. 3. Two timer chips or first and second timing circuits 30 and 31 are of a conventional type known as the 4541 timers and available on the commercial market as CD4541 Programmable Timer with Oscillator made by National Semiconductor Inc. and shown in its 1984 CMOS Data Book. Timer chip 30 has an input signal circuit at terminal 6 over circuit 45 which is produced upon burner or temperature conditioning apparatus operation at the input 32 whether it be the thermostat or some circuit closing upon burner operation. The presence of an output signal at 45 resets timer 30 and provides an output at 33 to energize fan relay 21. Contacts 21A of the fan relay then cause energization of circulator fan 11.

Timer 30 has a high rate of count to fill the timer in two minutes and a low rate of count to fill the timer in four minutes. The rate of count depends upon the resistance of circuit 34 and the input at 35. When the signal is removed from 45, timer 30 will begin to fill or count and the signal at 33 will remain to keep the circulation fan energized and provide a variable delay until the timer is completely filled.

Timer 31 has a counting rate to fill in four minutes. Upon receiving an input when the relay 21 is energized at 40, timer 30 is reset and begins a counting fill. When timer 31 completely fills after four minutes, an output at 35, which is connected to the circuit 34 of timer 30, is provided to change the counting rate of timer 30 by modifying the resistance circuit 34.

DESCRIPTION OF THE OPERATION

Referring to the graph in FIG. 2, let us assume that the burner ON time is one minute. Upon energization of input 45 to timing circuit 30 in FIG. 3, the timing circuit is reset and circulation fan relay 21 is energized. After the one minute burner operation the input signal at 31 is terminated and the timing circuit is allowed to count and fill at the fast rate to provide for the two minutes of fan operation before the signal at 33 is removed. The second timing circuit has no particular effect on the one minute burner operation. Let us select a burner ON time of five minutes, as shown in FIG. 2. With the resetting of the timing circuit 30 and the energization of the circulation fan relay, operation would be similar to the one minute burner cycle. The energization of the second timing circuit 31 again takes place. As the second timing circuit fills up in four minutes, after four minutes of operation, an output is provided at 35 to modify the resistance of circuit 34 and change the fill rate of timing circuit 30 to a slow fill rate and maintain the energization of fan relay 21 after the removal of input signal 30 at 45 for four minutes, as shown in FIG. 2. To obtain the sloping characteristic 22, assume that a three minute operation of the burner takes place. With a three minute burner operation, the second timer circuit 31 would only be three-fourths filled so that upon termination of input signal 45 by the termination of the burner operation, both timing circuit 30 and second timing circuit 31 continues to fill. The timing circuit 30 is filling at a high rate for the next minute, and timing circuit 31 completing its fill in the next minute. The output at 35 modifies the rate of fill of timing circuit 30 and thus the slower rate of fill would make the second half of fill of timing circuit 30 at a two minute fill period. This then keeps relay 21 energized for a total of three minutes to provide the characteristic of line 22 in FIG. 2.

The embodiments of the invention in which an exclusive property or right is claimed are defined as follows:

1. A fan control for use in system for controlling the termination operation of an air circulating fan delivering temperature conditioned air to a space in response to an operating time of a temperature conditioning apparatus comprising:

circuit means having an input circuit and an output circuit, circuit connection means adapted to connect said input circuit to receive a signal when the temperature conditioning apparatus is operating, second circuit connecting means adapted to connect an output signal of said output circuit to maintain the air circulating fan operating, and power supply means adapted to be connected to a source of power, said power supply means having an output connected to said circuit means, said circuit means having variable delay means for delaying the termination of said air circulating fan operation in response to the total period of each continuous operation of said temperature conditioning apparatus, wherein said circuit means comprises first and second timing circuits, said first timing circuit being reset to zero when said signal indicative of temperature condition apparatus operation is received and commences to count when said signal is terminated, said first timing circuit maintains said output signal to keep the fan operating for a first period of time until said count is completed, and said second timing circuit is adapted to respond to fan operation to change the rate of count of said first timing circuit after the fan operates for a predetermined period.

2. The invention of claim 1, wherein said first timing circuit has a normal high rate of count and a low rate of count depending upon a resistance of a control circuit, and said second timing circuit has a high rate of count and when filled changes said resistance of said first timing circuit.

3. The invention of claim 2, wherein said first timing circuit fills at said high rate in two minutes and fills at said low rate in four minutes, said second timing circuit fills in four minutes, whereby for temperature conditioning apparatus operation of zero to two minutes the fan remains operative for two minutes after termination of said burner, for temperature conditioning apparatus operation between two and four minutes the fan remains operative for a proportional longer time, and for temperature conditioning apparatus operation over four minutes the fan remains operative for four minutes after said temperature conditioning apparatus is turned off.

4. An improvement in a timer control adapted to maintain a circulating fan of a temperature conditioning apparatus operating for a predetermined time after the operation of the temperature conditioning apparatus has terminated, the improvement comprising, timing circuit means having a timing operation which varies with the length of an input signal, whereby the time the circulating fan remains operative after the termination temperature conditioning apparatus operation is a function of the length of time the temperature conditioning apparatus was operating, said timing circuit means comprising, a first timing device having a high rate of fill before a first output signal is removed and a low rate of fill before said output signal is removed, said timing circuit device has an input circuit to reset said timing device when an input signal exists and start a timing count to fill said timing circuit when said input signal is removed, a second timing device having another rate of fill, said second timing device is reset and counts when said first timing device begins a time count, said second timing device having an output connected to said first timing device to change said rate of fill when said second timing device is filled to finish its count, and said output signal of said first timing device varying in time with the time of said input signal.

* * * * *